US005457923A

United States Patent [19]

Logan et al.

[11] Patent Number: 5,457,923

[45] Date of Patent: Oct. 17, 1995

[54] DECORATIVE MOLDING STRIP

[75] Inventors: Richard Logan, Kingsville, Canada; Charles E. Schiedegger, Metamora, Mich.

[73] Assignee: Mid-America Building Products Corporation, Plymouth, Mich.

[21] Appl. No.: 143,253

[22] Filed: Oct. 26, 1993

Related U.S. Application Data

[63] Continuation-in-part of Ser. No. 158,163, Nov. 24, 1993, Pat. No. 5,398,469, which is a continuation of Ser. No. 916,399, Jul. 20, 1992, abandoned.

[51] Int. Cl.[6] ..... E04F 19/04

[52] U.S. Cl. ..... 52/288.1; 52/287.1; 52/272; 52/718.01

[58] Field of Search ..... 52/280, 288.1, 52/272, 273, 253, 254, 255, 257, 241, 716, 287.1, 718.01

[56] References Cited

U.S. PATENT DOCUMENTS

| | | | |
|---|---|---|---|
| 417,949 | 12/1989 | Sagendorph | 52/287 |
| 1,229,765 | 6/1917 | Lehman | 52/287 |
| 2,114,044 | 4/1938 | Bonnell | 52/280 |
| 3,201,910 | 8/1965 | Keesee | 52/287 |
| 3,302,350 | 2/1967 | Brown | 52/287 |
| 3,464,177 | 9/1969 | Amato | 52/288 |
| 3,481,092 | 12/1969 | Constantino | 52/288 |
| 3,616,587 | 11/1971 | Schalfly | 52/288 |
| 4,091,586 | 5/1978 | Schwartz | 52/288 |
| 4,709,522 | 12/1987 | Carnahan | 52/287 |
| 5,001,877 | 3/1991 | Edwards | 52/288 |

FOREIGN PATENT DOCUMENTS

| | | | |
|---|---|---|---|
| 7413048 | 4/1976 | Netherlands | 52/288 |
| 567798 | 8/1977 | U.S.S.R. | 52/288 |
| 2040386 | 8/1980 | United Kingdom | 403/231 |
| 2191518 | 12/1987 | United Kingdom | 52/288 |

*Primary Examiner*—Michael Safavi
*Assistant Examiner*—Winnie S. Yip
*Attorney, Agent, or Firm*—Barnes, Kisselle, Raisch, Choate, Whittemore & Hulbert

[57] ABSTRACT

A decorative molding for a corner formed by a ceiling and a vertical wall comprises a thin strip of flexible plastic and is secured to the wall by an attachment allowing the molding strip along its upper and lower edges to be flexible to conform with uneven surfaces in the ceiling and/or wall. In one form the strip is attached to the wall by an adhesive. In another form, a wall track and clip arrangement is utilized to provide easy removal from the wall for paint or wallpaper application. A corner element is provided in one form in which ends of the strips are adhesively secured thereto in overlapping engagement. In another embodiment, the strips are telescopically connected to the corner element.

11 Claims, 6 Drawing Sheets

DECORATIVE MOLDING STRIP

This application is a continuation-in-part of U.S. application Ser. No. 08/158,163 filed Nov. 24, 1993, now U.S. Pat. No. 5,398,469, which is a continuation of U.S. application Ser. No. 07/916,399, filed Jul. 20, 1992 now abandoned.

FIELD OF THE INVENTION

This invention relates to decorative molding installed at a corner formed by the juncture of a ceiling and a vertical wall. Particularly, this invention relates to systems for mounting the molding to the corner.

BACKGROUND OF THE INVENTION

In the past, various moldings have been provided as disclosed and described, for example, in U.S. Pat. Nos. 3,302,350; 3,481,092 and 3,616,587. These patents disclose various methods of attaching the molding strip to the corner juncture. However, these methods are undesirable in that the mounting is permanent and/or rigid causing difficulties in modifying decorative features of a house in many applications. For example, in many older homes the surface of the walls and ceilings are uneven due to settling of the house or water damage, for example. Firm and secure attachment of the prior art devices would be difficult due to the fact that the upper and lower surfaces of the molding are rigidly and/or permanently attached to the ceiling and wall. In Brown et al ('350) the walls of the mounting member are rigidly connected to the ceiling and wall by screws. The Constantino ('092) device is attached by applying adhesive to the flat upper and lower edges of the molding. In Schlafly, Jr. ('587) the upper and lower edges of the molding are rigidly attached to the walls by clips. Thus, it can be seen that the rigid mounting of these prior art devices do not allow the molding to conform or adjust to uneven wall surfaces.

The present invention overcomes these difficulties by providing a mounting system that allows the flexible decorative molding to conform to uneven surfaces in a wall and/or ceiling.

SUMMARY OF THE INVENTION

The present invention provides a flexible decorative molding system which has a thin molding strip of flexible plastic secured to the wall by a mount so that the upper and lower edges of the molding strip can flex to conform with uneven surfaces in the wall. In one form, the molding strip is attached to the wall by an adhesive. In another form, a wall track is mounted to the wall and a clip is attached to the molding strip for interconnection with the wall track to provide easy removal for paint or wallpaper application. The interconnection between the wall track and the clip is flexible to allow the clip to engage therewith in a snap action fit. In yet another embodiment, the molding strip may have undulations or stepped portions to add strength to the central portion thereof. Additionally, the wall track may have an extension to engage and further support the central portion of the molding strip. In a further embodiment, the molding strips may be connected end-to-end. In one form, each molding strip has a retainer secured in spaced relation thereto at each end and a sliding connector having a spring tab formed therein is telescopically received by the retainer and is secured by the spring tab. In another form, one of the molding strips is provided with a retainer in spaced relation thereto with openings and a connector with spring tabs fixed to the end of an adjacent molding strip. The connector is telescopically received between the retainer and molding strip and secured by engagement of the spring tabs in the opening in the retainer. A corner element is provided which is adhesively secured in overlapping engagement with the molding strips. In another embodiment, the molding strips are telescopically connected to the corner element.

OBJECTIVES OF THE INVENTION

Among the objectives of this invention are to provide a mounting system for decorative molding that is flexible allowing the strip to conform to expansion, contraction or uneven surfaces in the wall and/or ceiling yet secure enough to adequately maintain the molding in place; that is easy to install requiring little or no skills; that is easily removable to allow for painting, wallpaper application or other decorating features; and that provides an attractive and decorative molding that is less costly than wood moldings, can be supplied with a pre-finished wood grain, and can be stained or painted.

DETAILED DESCRIPTION

The invention provides a decorative molding strip made of molded plastic material such as polystyrene, for example, and is vacuum or pressure formed into flexible strips thin enough to flex lengthwise as well as about the width.

Figure 1:
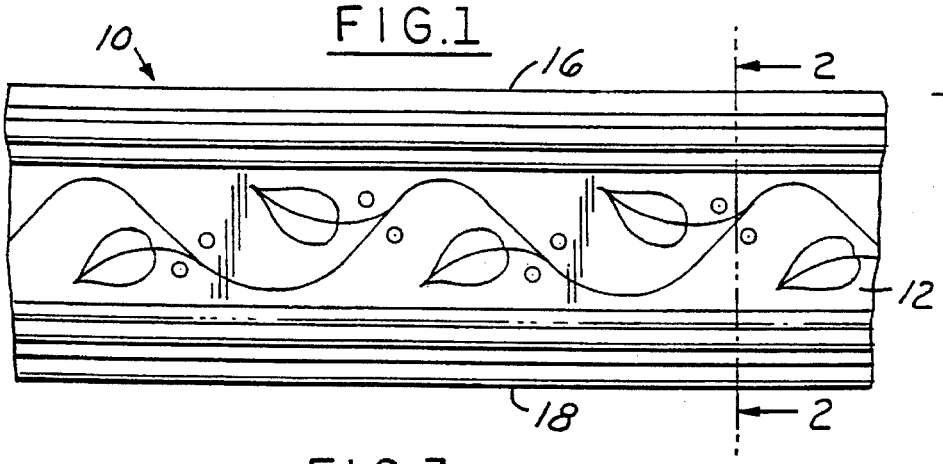
FIG. 1 is a front elevational view of a first embodiment of the molding strip.

FIGS. 1–8 show a first system for mounting various embodiments of the molding strip which comprises an adhesive attachment. FIG. 1 shows a first embodiment of the invention where molding strip 10 has a decorative front surface 12, a back surface 14 an upper edge 16 and a lower edge 18. An adhesive 20, for example, double sided pressure sensitive tape, is attached to the back surface 14 of the strip 10. The strip with the adhesive is then attached to a vertical wall (shown in phantom). The upper edge 16 fits snugly against the vertical wall at the point of intersection between the wall and the ceiling. The lower edge 18 is also resiliently held against the vertical wall.

FIGS. 3–8 show several other embodiments of molding strips having various designs and contours. The upper edges are angled outwardly from the wall to which the strip is mounted so as to engage the ceiling thus giving the appearance of angled corner molding as opposed to flat molding as appears in the embodiment of FIGS. 1 and 2. The only differences between the embodiments of FIGS. 3–8 are the decorative features of the front faces 24, 34, 44 and the angle of inclination of the upper edges 28, 38, 48. The molding strips are mounted to a vertical wall by an adhesive strip 31, 41, 51 in the same manner as molding strip 10 of FIG. 1. However, the upper edges 28, 38, 48 resiliently and snugly bear against the ceiling for firm engagement therewith. The upper edges may be flexed about their respective mounting adhesive strips from the unflexed position (shown in phantom) prior to mounting to the final flexed position shown in solid lines in FIGS. 4, 6 and 8. The lower edges 30, 40, 50 are resiliently and snugly held against the vertical wall.

Figure 4:
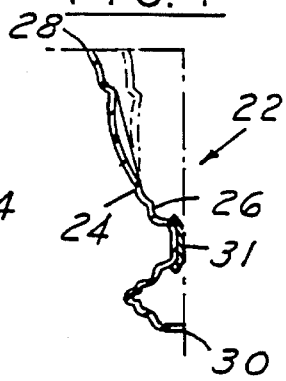
FIG. 4 is a sectional view taken along the line 4—4 in FIG. 3.
Figure 5:
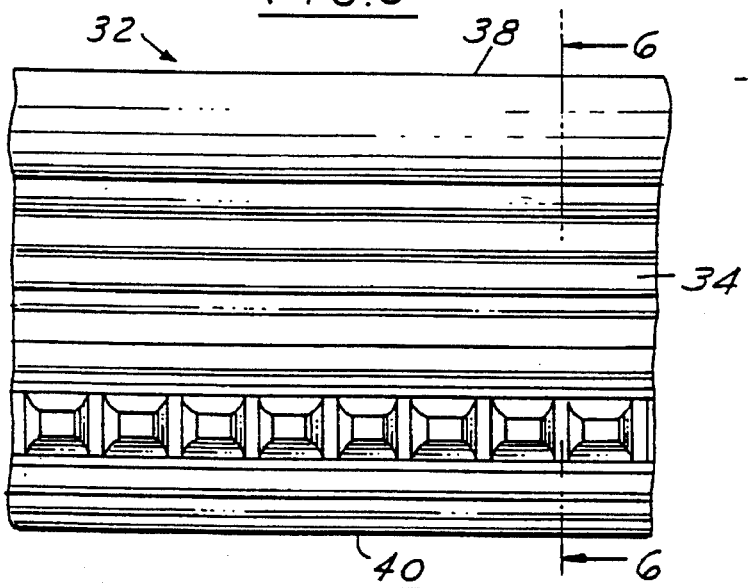
FIG. 5 is a front elevational view of a third embodiment of the molding strip.
Figure 6:
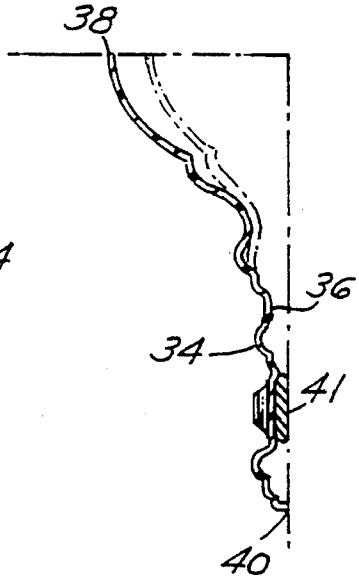
FIG. 6 is a sectional view taken along the line 6—6 in FIG. 5.
Figure 23A:
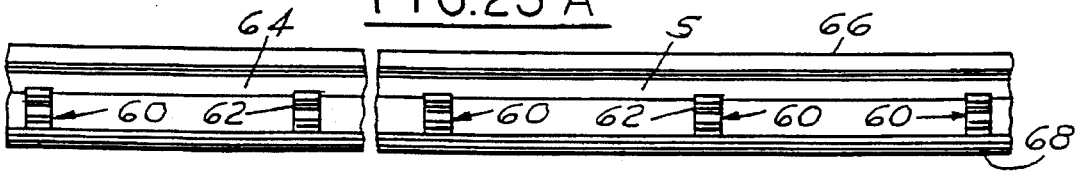
FIG. 23A is a fragmentary rear elevational view of a molding strip with a plurality of flexible plastic clips attached thereto.
Figure 7:
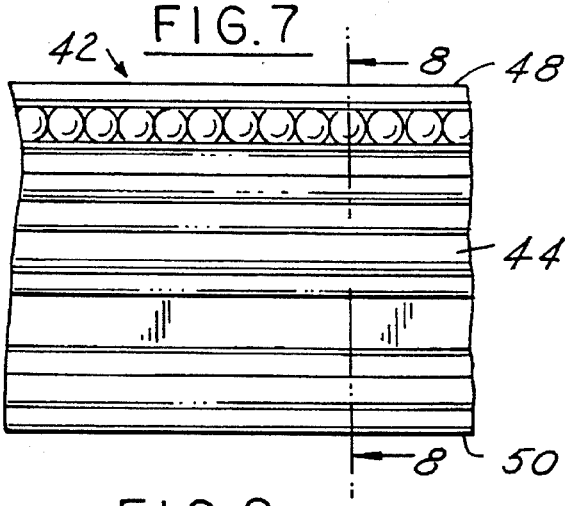
FIG. 7 is a front elevational view of a fourth embodiment of the molding strip.
Figure 8:
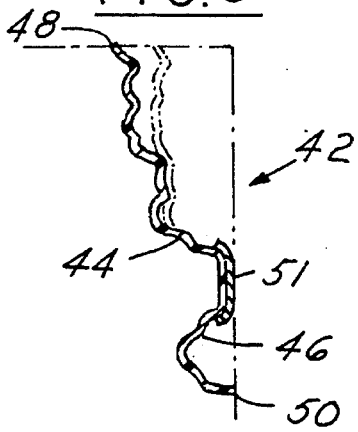
FIG. 8 is a sectional view taken along line 8—8 in FIG. 7.

One feature common to all of the above embodiments is that at least the upper edges, and preferably the lower edges, are flexed about the point of attachment to the wall, i.e. about the adhesive strip, for example at 31 in FIG. 4. Regarding FIGS. 1 and 2, the flexing of the upper and lower edges 16, 18 would not be as dramatic as seen in the embodiments of FIGS. 3–8; however, enough flexing occurs to enable the upper and lower edges 16, 18 to be resiliently flexed into snug engagement with the vertical wall.

Figure 9:
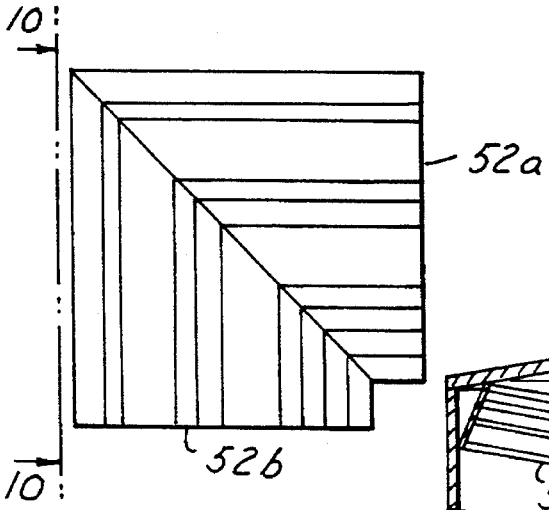
FIG. 9 is a plan view of a corner molding element.
Figure 10:
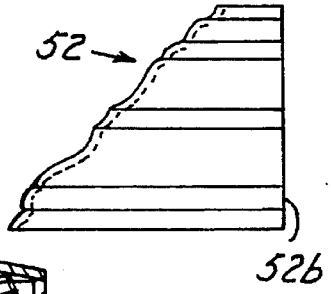
FIG. 10 is a sectional view taken along the line 10—10 in FIG. 9.
Figure 11:
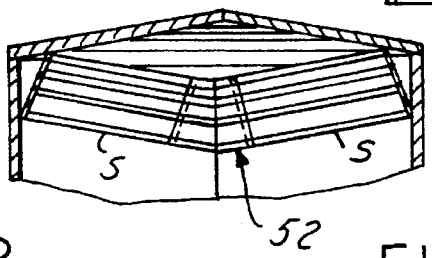
FIG. 11 is a fragmentary perspective view of the molding strips and corner piece in place.
Figure 12:
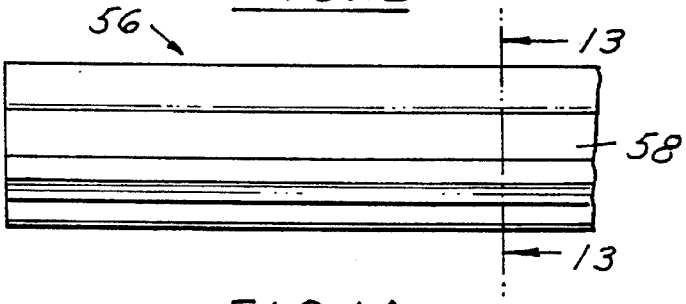
FIG. 12 is a front elevational view of a wall track.
Figure 13:
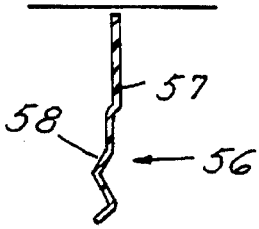
FIG. 13 is a sectional view taken along the line 13—13 in FIG. 12.

FIGS. 9 and 10 show a corner molding element 52 used with molding strips of similar transverse configuration, the ends of which would either abut or, preferably, slightly overlap behind the ends 52*a*, 52*b* of the corner element 52 and which are secured thereto by adhesive means. For example, in FIG. 11 the ends of the molding strips S adjacent the corner element 52 are adhesively secured in overlapping engagement behind the ends 52*a*, 52*b* of the corner element. The corner piece is then supported by the molding strips and, as shown mounted to molding strips S in FIG. 11, is used to eliminate the requirement of mitering the ends of the molding strips for a corner fit.

Figure 2:
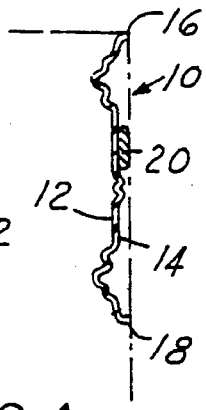
FIG. 2 is a sectional view taken along the line 2—2 in FIG. 1.
Figure 3:
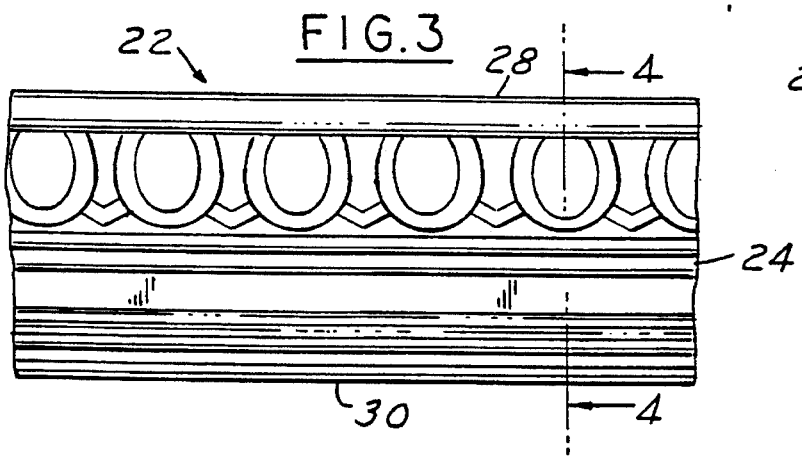
FIG. 3 is a front elevational view of a second embodiment of the molding strip.
Figure 14:
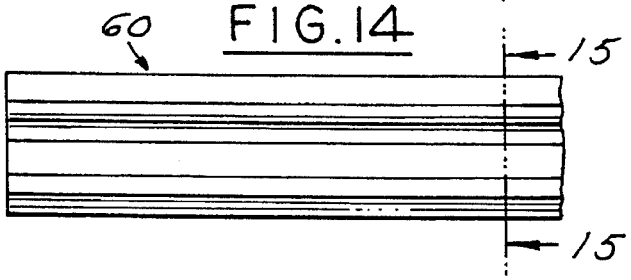
FIG. 14 is front elevational view of a mounting clip.
Figure 15:
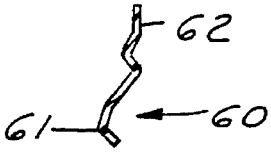
FIG. 15 is a sectional view taken along the line 15—15 in FIG. 14.
Figure 16:
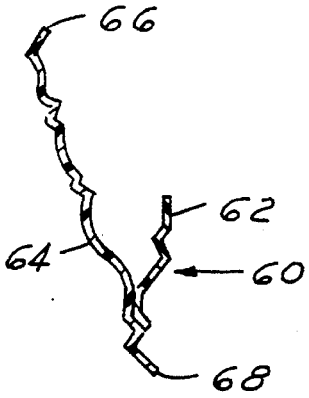
FIG. 16 is an end view of a molding strip with a mounting clip attached.
Figure 17:
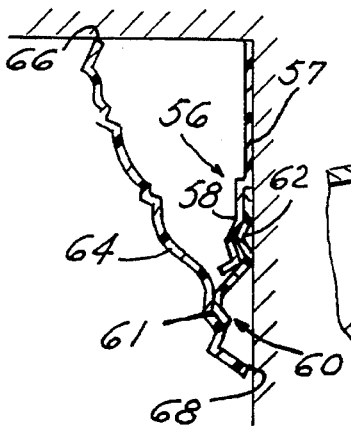
FIG. 17 is an end view of a molding strip mounted to a wall.
Figure 20:
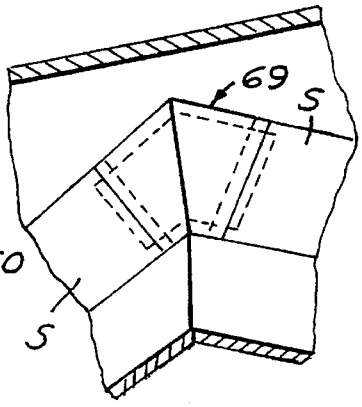
FIG. 20 is a fragmentary perspective view of the molding strips and corner piece attached to the walls.
Figure 18:
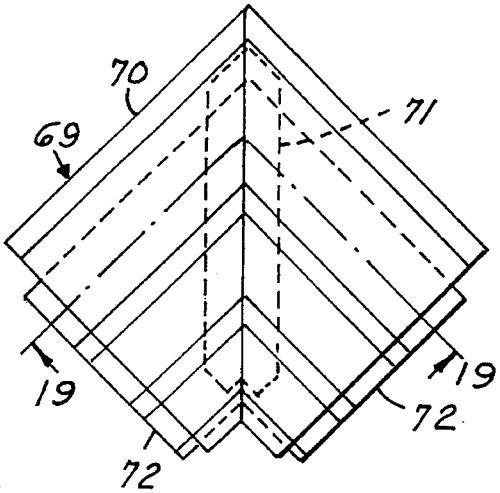
FIG. 18 is a plan view of a modified corner molding element.
Figure 19:
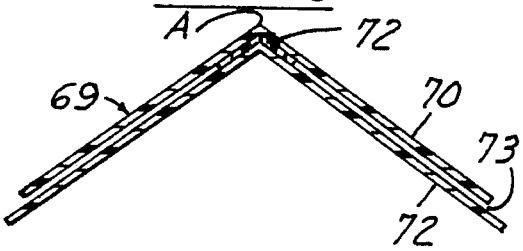
FIG. 19 is a sectional view taken along the line 19—19 in FIG. 18.

FIGS. 12–17 show a second embodiment of the mounting system. This system comprises a wall track 56 (FIGS. 12, 13) and a plurality of short clips 60 (FIGS. 14, 15). The wall track 56 is comprised of a thin plastic piece which has a back surface 57 adapted to be mounted on a wall and a forward leading edge 58 with angled undulations 59 extending lengthwise of the wall track 56 and spaced from the wall providing a gap between the leading edge 58 and the wall. The wall track 56 runs substantially the length of the molding strip to be mounted thereon. The upper edge of the wall track 56 abuts the ceiling to give the proper spacing to allow the upper edge 66 of the molding strip 64 to fit tightly against the ceiling. The wall track is mounted by any means, such as adhesive similar to adhesive 20 (FIG. 2). The clips 60 (FIG. 14) are a thin piece of plastic adapted to be mounted to the back surface of a molding strip 64 at a point 61 (FIG. 15) at spaced locations therealong and are flexible relative thereto. The clips 60 have a forward edge 62 with angled undulations 63 extending lengthwise thereof and correspond to the undulations 59 on the leading edge 58 of the wall track 56. The forward edge 62 is adapted to be received within the gap between the forward leading edge 58 of the wall track and the wall (FIG. 17) so that the corresponding angled undulations 59,63 on the wall track 56 and the clips 60 are interengaged to form a secure connection. The leading edge 58 of the wall track is flexible about its mounting point 57 and the flexibility of the forward edges 62 of the clips allows the leading edge 68 and the forward edges 62 to engage in a snap action fit to resiliently but firmly hold the molding strip in place. As can be seen in FIG. 17, upper edge 66 is flexed about the point 61 at which the clip 60 is mounted to the back surface of the molding strip. Similarly, the lower edge 68 is flexed about the same point to be snugly received against the vertical wall.

One advantage of the embodiments of FIGS. 12–17 is that the molding strip 64 can be easily removed via the snap action fit to allow for painting, wallpapering or other decoration.

Also, the molding strips of the above embodiments are flexible about their lengths as well as their widths to provide conforming engagement with uneven wall surfaces and to allow for expansion and contraction due to weather and/or temperature conditions. For instance, when mobile or modular homes are stored, the interior temperature can exceed 125° F.

Figure 21:
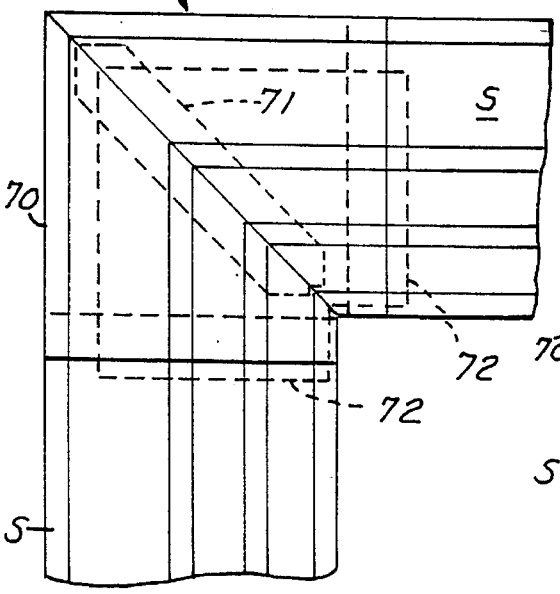
FIG. 21 is a front view of the mounting strips attached to the modified corner molding element shown in FIG. 18.
Figure 22:
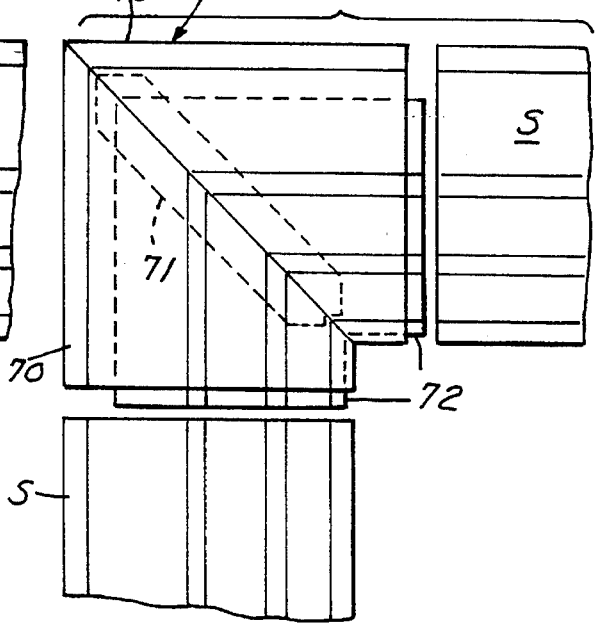
FIG. 22 is an exploded view of the molding strips and the modified corner molding element shown in FIG. 21.

FIGS. 18–22 show a modified corner molding element 69 adapted for use with molding strips of similar transverse configuration. This embodiment comprises an upper corner element 70 and a lower corner element 72 attached along the apex A by securing means 71, such as an adhesive, leaving a small gap 73 between the upper and lower corner elements 70, 72. The gap 73 is adapted to telescopically receive ends of molding strips S having similar configurations to the corner molding pieces in snug and secure telescopic engagement (FIGS. 21, 22). For example, FIG. 22 shows the molding strips S and corner elements 70, 72 prior to connection. The ends of the strips S are then inserted into gap 73 (FIG. 19) at each end of the corner element 69 (FIG. 21). The resulting mounting arrangement for an outside corner appears in FIG. 20. However, it is understood that the corner molding element 69 is also adapted for use with an inside corner. The corner molding element is then supported by the molding strips S.

Figure 23:
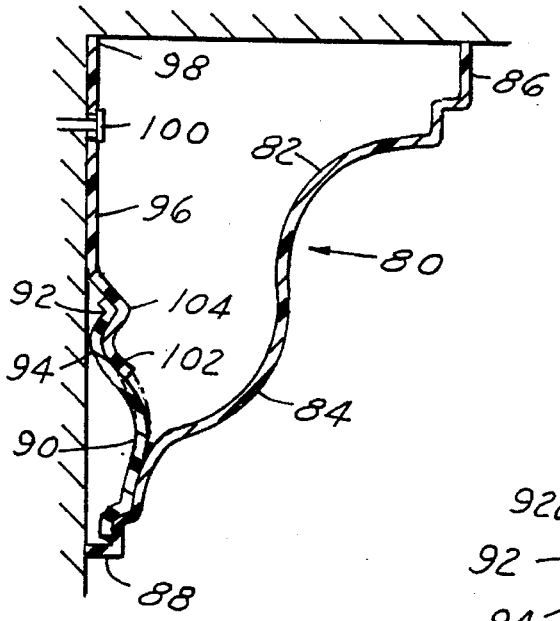
FIG. 23 is a sectional view of another embodiment of the molding strip.
Figure 24:
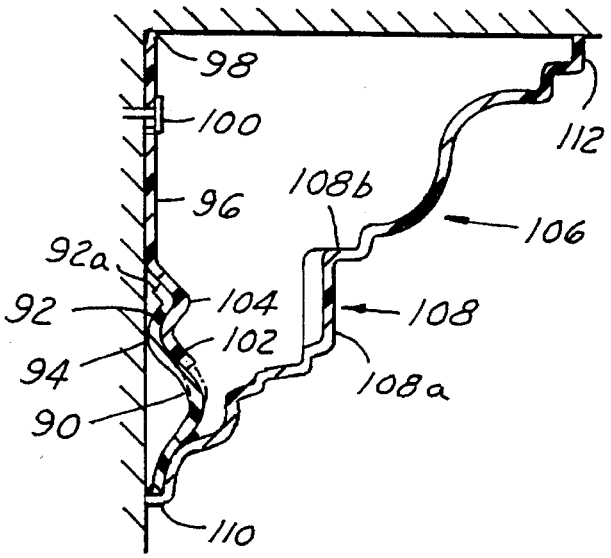
FIG. 24 is a sectional view of a further embodiment of the molding strip.
Figure 25:
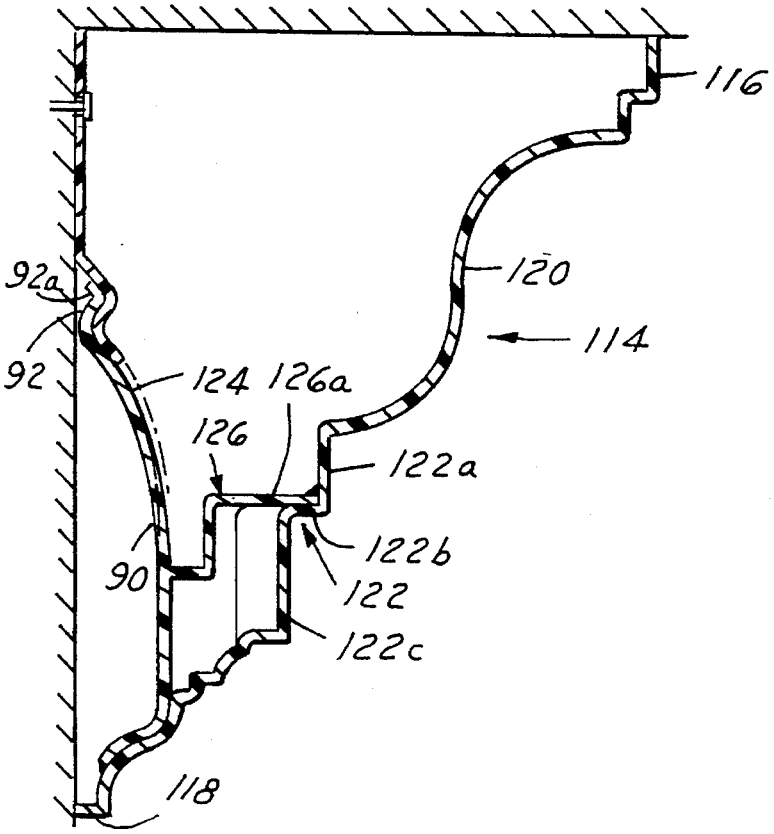
FIG. 25 is a sectional view of yet another embodiment of the molding strip.
Figure 26:
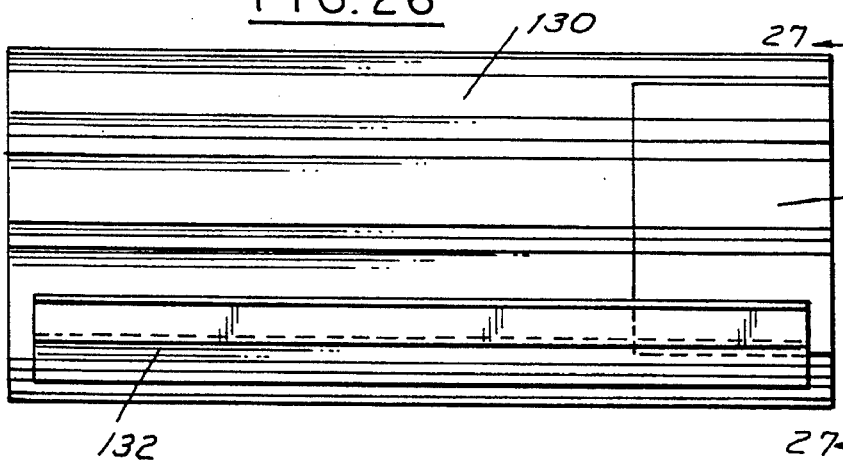
FIG. 26 is a rear view of another embodiment of the molding strip.
Figure 27:
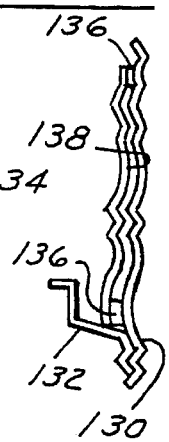
FIG. 27 is an end view of the molding strip taken along the line 27—27 in FIG. 26.
Figure 28:
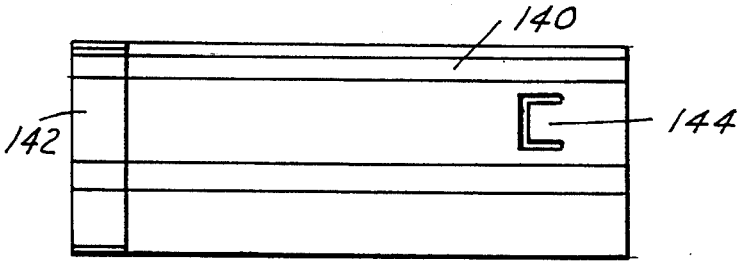
FIG. 28 is a rear view of a connector.

FIGS. 23–25 show other embodiments of molding strips having various contours and shapes. In FIG. 23, the molding strip 80 has curved undulations 82,84 that extend along the length thereof adding strength and rigidity to the central portion of the molding strip 80. The upper and lower edges 86,88 abut their respective walls to extend substantially perpendicular thereto. A plurality of clips 90 are adhesively secured to the back surface of the molding strip 80. Each clip 90 has a forward V-shaped edge 92 and longitudinally extending undulations 94. Each clip 90 is flexible about the point of attachment to the molding strip 80 and is movable from an unflexed position, shown in phantom, to a flexed position where longitudinally extending undulations 94 in the clips 90 are engaged with the wall track 96.

The wall track 96 is substantially the same as in the previous embodiments being mounted to one of the walls, shown as being the vertical wall, where the upper edge 98 abuts the other wall, shown as the ceiling. The wall track 96 is mounted to its associated wall by any means such as nails 100. The leading edge 102 is spaced from the vertical wall leaving a gap therebetween. The leading edge 102 has longitudinally extending undulations 104 corresponding to the forward edge 92 and the undulations 94 in the clips 90. When the molding strip is mounted, the clips 90 and the leading edge 102 of the wall track 96 flex so that the corresponding undulations 94,104 engage in a snap action fit. The forward edge 92 of the clip 90 provides easy engagement between the clip 90 and the wall track 96. Additionally, the V-shape of the forward edge 92 cooperates with the undulations 104 in the wall track 96 to act as a stop preventing the clip 90 from moving further upward. Once in place, the forward edge 92 securely locks the clip 90, and thus the molding strip 80, to the wall track 96. The snap action fit between the clips 90 and the wall track 96 forces the lower edge 88 of the molding strip 80 into firm engagement with the vertical wall while the upper edge 86 of the molding strip 80 is flexible relative to where the clips 90 are mounted thereto to conform to uneven wall or ceiling surfaces.

The molding strip 106 of FIG. 24 is mounted substantially in the same manner as the mounting strip 80 of FIG. 23 but has a different contour to span a greater distance from the vertical wall. The molding strip 106 has a substantially central stepped portion 108 having a first vertical wall **108*a* extending substantially parallel to the vertical wall and a second horizontal wall 108*b* extending substantially perpendicular thereto adding strength and rigidity to the central portion of the molding strip 106. As with the previous embodiments, the V-shaped forward edge 92*a* of each clip 90 provides ease of engagement with the wall track 96 as well as providing the stop and lock functions. Once in place, the lower edge 110 of the mounting strip 106 is forced into firm engagement with the vertical wall. The upper edge 112 is flexible relative to the mounting of the clips 90 thereto but is also somewhat flexible relative to the stepped portion 108** to conform to any uneven surfaces in the ceiling.

The molding strip 114 of FIG. 25 has upper and lower edges 116,118, a curved portion 120 and a stepped portion 122 to give additional strength and rigidity thereto to allow the molding strip to span an even greater distance from the vertical wall. In this embodiment, the wider width of the molding strip 114 requires modified wider clips 124 having a stepped extension 126 to engage the stepped portion 122 of the mounting strip 114. The stepped portion 122 adds strength and rigidity to the molding strip 114 and has a vertical wall **122*a*, a horizontal wall 122*b* and vertical wall 122*c*. The leg 126*a* of extension 126 rests on wall 122*b* and abuts wall 122*a* of the stepped portion 122 to give added strength and support to the central portion of the mounting strip. The upper edge 116 of the mounting strip 114 is flexible relative to where the clips 124 are mounted thereto as well as to the stepped portion 122 to conform to any uneven ceiling surfaces. The forward edge 92*a* of each clip 90 acts in the manner described above to allow the clips 90** to be easily secured to the wall track while providing a firm engagement therewith.

Figure 29:
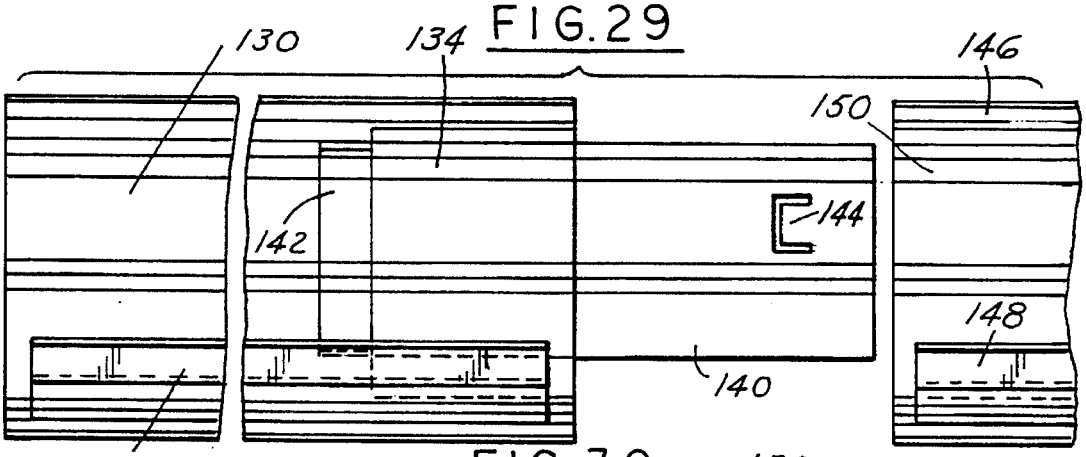
FIG. 29 is an exploded fragmentary rear view of the molding strip with the connector and an adjacent molding strip.
Figure 30:
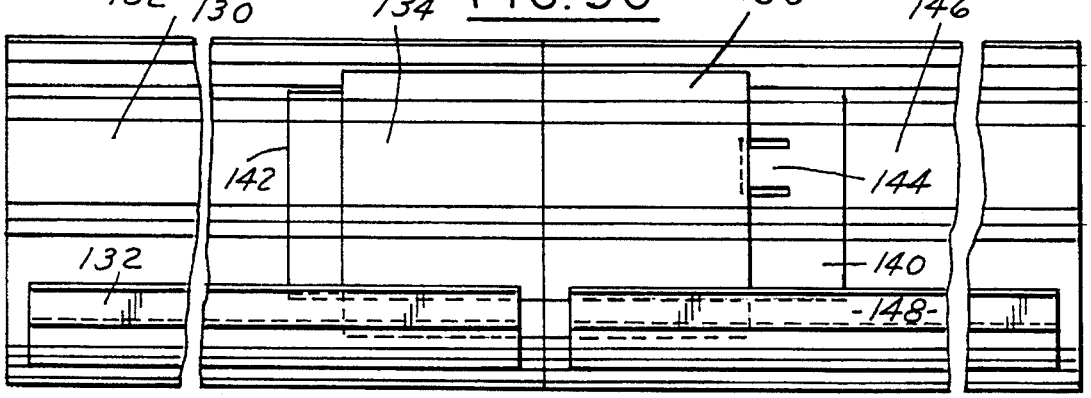
FIG. 30 is a fragmentary rear view of the molding strips connected.
Figure 31:
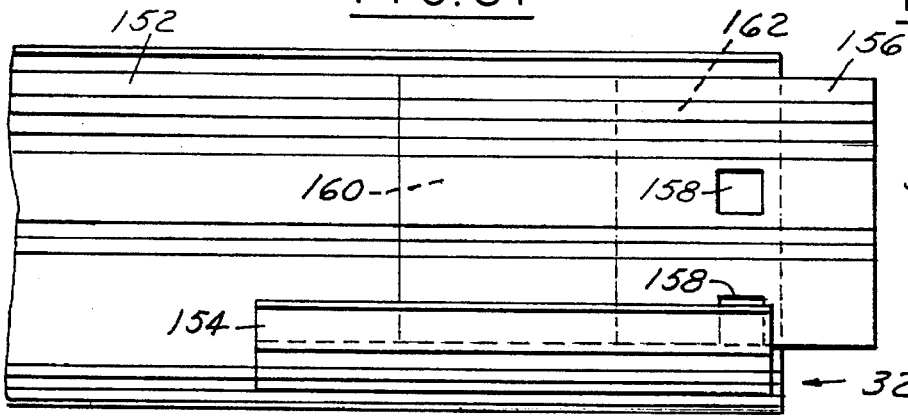
FIG. 31 is a fragmentary rear view of yet a further embodiment of the molding strip.
Figure 32:
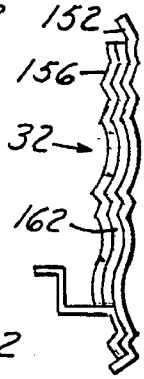
FIG. 32 is an end view of the molding strip taken along the line 32—32 in FIG. 31.
Figure 33:
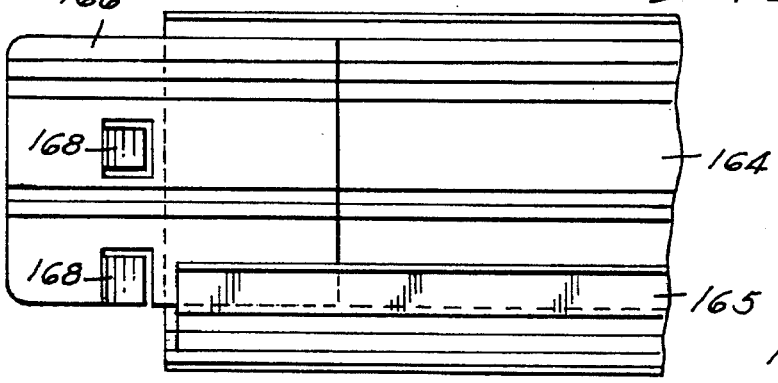
FIG. 33 is a fragmentary rear view of an adjacent molding strip.
Figure 34:
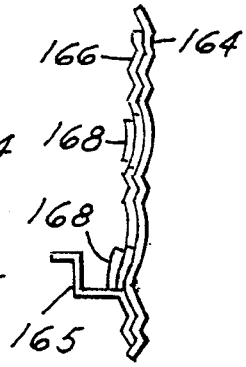
FIG. 34 is an end view of the molding strip taken along the line 34—34 in FIG. 33.

FIGS. 26–30 show another embodiment where the molding strips can be connected end-to-end. A molding strip 130 has a mounting clip 132 secured thereto and is mounted to a wall track in a manner set forth in the previous embodiments. In order to connect adjacent molding strips end to end, each molding strip is provided with a retainer 134 secured thereto by an adhesive 136 in spaced relation thereto to form a gap 138. A sliding connector 140 is provided having the same transverse contour as the molding strip 130. The connector 140 has a stop member 142 secured at one end and a spring tab 144 formed in the opposite end thereof. As can be seen in FIGS. 29 and 30, the connector 140 is slidingly connected to the molding strip 130 by inserting the end of the connector 140 with the spring tab 144 into the gap 138. The connector 140 is thus telescopically received between the retainer 134 and the molding strip 130 and slides therebetween until the stop member 142 abuts the retainer 134. An adjacent molding strip 146 has a mounting clip 148 and a retainer 150 similar to the molding strip 130. The connector 140 is then telescopically received between the adjacent molding strip 146 and its retainer 150 while the stop member 142 is held in place by the user until the spring tab 144 is free to snap behind and engage the retainer 150 to hold the molding strips 130, 146 together.

Figure 35:
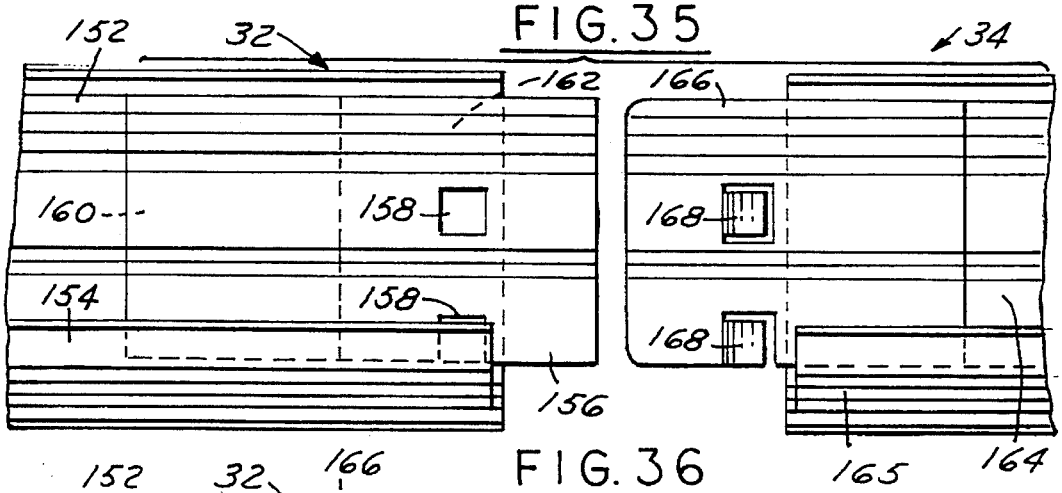
FIG. 35 is a fragmentary exploded rear view of the adjacent molding strips.
Figure 36:
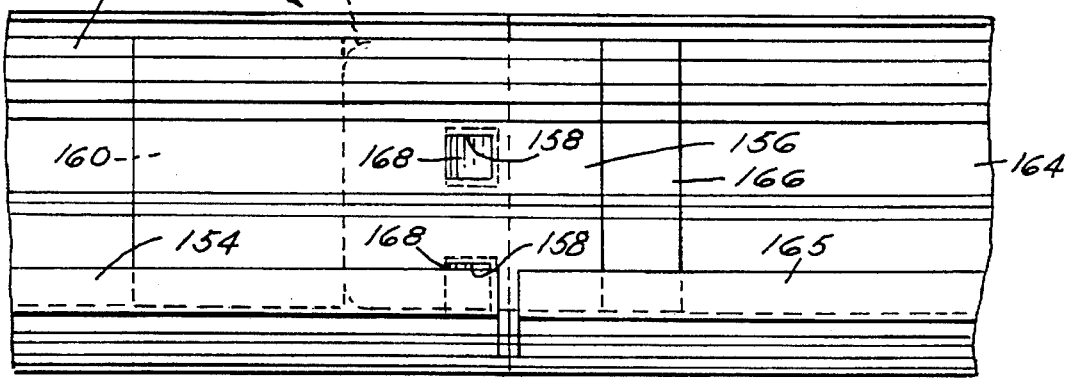
FIG. 36 is a fragmentary rear view of the adjacent molding strips connected.

FIGS. 31–36 show another embodiment of the present invention for mounting molding strips in an end-to-end relation. The molding strip 152 has a mounting clip 154 secured thereto and is attached to a wall track in the same manner set forth in the previous embodiments. A retainer 156 having substantially the same transverse configuration as the molding strip 152 and having openings 158 formed therein is adhesively secured to the molding strip 152 by a spacer 160 creating a gap 162 between the retainer 156 and the molding strip 152. An adjacent molding strip 164 has a connector 166 adhesively secured to one end. The connector 166 has spring tabs 168 punched or otherwise formed therein. As can be seen in FIG. 35, the adjacent molding strips 152, 164 are placed end-to-end and aligned so that the connector 166 can be telescopically received within gap 162 until the spring tabs 168 engage the openings 158 to retain the molding strips 152, 164 together.

It can thus be seen that a decorative molding mounting system has been provided that is flexible and able to conform to uneven wall surfaces, is easy to install, is easily removable for wallpaper application or painting and is less costly than wood moldings.

We claim:

1. A decorative molding formed by a ceiling and a vertical wall, said molding comprising:

a first thin molding strip of flexible plastic and a second thin molding strip of flexible plastic, each said thin molding strip of flexible plastic having an upper free edge, a lower free edge, a front surface and a back surface, said upper free edge being adapted to lie against one of said ceiling and said vertical wall, said lower free edge adapted to lie against the other of said ceiling and said vertical wall, a plurality of flexible plastic clips, each said flexible plastic clip having a first end and a second end, means for mounting each said clip with the first end on the back surface of each said molding strip at a point of attachment intermediate the upper free edge and the lower free edge of said each molding strip, said second end of each said clip defining a free end, each said clip being capable of flexing, a wall track of flexible plastic having a back surface, a front surface, an upper free edge and a lower forward free edge, means for mounting said track adjacent the upper free edge of the track on one of said ceiling and said vertical wall such that said lower forward free edge is spaced from the one of said ceiling and said vertical wall, said lower forward free edge of said track being capable of flexing relative to said upper free edge of said track, interengaging means on said second end of each said clip and said lower forward free edge of said track such that when the second end of each said clip and said lower forward free edge of said track are engaged said thin molding strip is restrained against ready removal and such that when said molding strip is mounted on said wall track, each said clip is positioned between said lower forward free edge of said wall track and its associated wall to cause the lower forward free edge to flex so that said clip is restrained and removed by a snap-in fit, said first molding strip having a retainer secured to said first molding strip at one end with substantially the same transverse configuration as said first molding strip and mounted thereto in a spaced relation to form a gap, and a connector having a stop member at one end and a spring tab at the opposite end for telescopic engagement with said retainer and molding strip such that the stop member abuts said retainer.

2. The decorative molding of claim 1 wherein said connector is telescopically received between said first and second identical thin molding strips, said second thin molding strip having a retainer such that the spring tab of said connector engages the retainer of said second thin molding strip to secure the adjacent first and second thin molding strips end-to-end.

3. A decorative molding formed by a ceiling and a vertical wall, said molding comprising:

a first thin molding strip of flexible plastic and a second thin molding strip of flexible plastic, each said thin molding strip of flexible plastic having an upper free edge, a lower free edge, a front surface and a back surface, said upper free edge being adapted to lie against one of said ceiling and said vertical wall, said lower free edge adapted to lie against the other of said ceiling and said vertical wall, a plurality of flexible plastic clips, each said flexible plastic clip having a first end and a second end, means for mounting each said clip with the first end on the back surface of said each molding strip at a point of attachment intermediate the upper free edge and the lower free edge of said each molding strip, said second end of each said clip defining a free end, each said clip being capable of flexing, a wall track of flexible plastic having a back surface, a front surface, an upper free edge and a lower forward free edge, means for mounting said track adjacent the upper free edge of the track on one of said ceiling and said vertical wall such that said lower forward free edge is spaced from the one of said ceiling and said vertical wall, said lower forward free edge of said track being capable of flexing relative to said upper free edge of said track, interengaging means on said second end of each said clip and said lower forward free edge of said track such that when the second end of each said clip and said lower forward free edge of said track are engaged said thin molding strip is restrained against ready removal and such that when said molding strip is mounted on said wall track, each said clip is positioned between said lower forward free edge of said wall track and its associated wall to cause the lower forward free edge to flex so that said clip is restrained and removed by a snap-in fit, a retainer secured to said first molding strip at one end in a space formed therebetween, said retainer having openings formed therein, and a connector secured to an adjacent end of said second molding strip having spring tabs formed therein, such that said connector is telescopically received by said opening formed between the retainer and the first molding strip so that the spring tabs are engaged within the openings in said retainer to secure the first and second molding strips end to end.

4. A decorative molding system removably installed at a juncture of a ceiling and a vertical wall, said molding system comprising:

a thin molding strip of flexible plastic having a length and a width, said thin plastic molding strip having an undulating cross sectional configuration, said thin plastic molding strip having an upper free edge, a lower free edge, a front surface and a back surface, said upper free edge being adapted to lie against one of said ceiling and said vertical wall along a line spaced from the juncture of the ceiling and vertical wall and flex relative thereto, said lower free edge being adapted to lie against the other of said ceiling and said vertical wall along a line spaced from the juncture of the ceiling and vertical wall and flex relative thereto, said upper free edge and lower free edge having a configuration such that the molding strip is angled outwardly with respect to the wall and the ceiling, a plurality of flexible plastic clips, each said flexible plastic clip having a first end and a second free end, said flexible plastic clips being attached at spaced points along the length of the back surface of said molding strip at a point of attachment intermediate the upper free edge and lower free edge of said molding strip and said second free end of each said clip extends at an acute angle relative to the molding strip from said point of attachment, said second free end of each said clip being capable of flexing relative to said point of attachment to said molding, said molding strip being sufficiently flexible about its length as well as its width to provide conforming engagement of its upper free edge and its lower free edge with the ceiling and vertical wall to provide conforming engagement with the ceiling and vertical wall, a wall track of thin flexible plastic having a back surface, a front surface, an upper edge and a forward leading edge, said forward leading edge of said track being capable of flexing relative to the remainder of said track, means for mounting the upper edge of the track on one of said ceiling and said vertical wall adjacent the juncture of said ceiling and said vertical wall, first interengaging means integral with said forward leading edge of said track, second interengaging means integral with said second free end of each said clip, said first interengaging means and said second interengaging being constructed such that when the thin molding strip with the flexible plastic clips attached thereto is mounted on said track by movement of each said second free end of each said clip between the leading edge of said track, the second free end of each said clip is moved toward the leading edge of said track and said free ends of said clips flex and said first interengaging means interengage, such that said thin molding strip is restrained against ready removal, said molding strip, clips and track being constructed and arranged such that when said molding strip is in mounted position on said wall tack, the upper edge of said molding strip is angled outwardly from said track and said clips, such that each said clip is positioned between said lower forward free edge of said wall track and its associated wall to cause the forward leading edge of said track to flex so that each said clip is retained by a snap-in fit while permitting the upper free edge and lower free edge of said molding strip to flex into conforming engagement with the ceiling and vertical wall and said strip is removable by flexing of said clips, said first interengaging means on said forward leading edge of said track and said second interengaging means on said clips being constructed and arranged such that the molding strip can be easily removed to allow for painting, wall papering, or other decoration, said thin molding strip having a retainer secured to one end of said thin molding strip with substantially the same transverse configuration as said molding strip and mounted thereto in a spaced relation to form a gap, and a connector having a stop member at one end and a spring tab at the opposite end for telescopic engagement with said retainer and molding strip such that the stop member abuts said retainer.

5. A decorative molding system removably installed at a juncture of a ceiling and a vertical wall, said molding system comprising:

a thin molding strip of flexible plastic having a length and a width, said thin plastic molding strip having an undulating cross sectional configuration, said thin plastic molding strip having an upper free edge, a lower free edge, a front surface and a back surface, said upper free edge being adapted to lie against one of said ceiling and said vertical wall along a line spaced from the juncture of the ceiling and vertical wall and flex relative thereto, said lower free edge being adapted to lie against the other of said ceiling and said vertical wall along a line spaced from the juncture of the ceiling and vertical wall and flex relative thereto, said upper free edge and lower free edge having a configuration such that the molding strip is angled outwardly with respect to the wall and the ceiling, a plurality of flexible plastic clips, each said flexible plastic clip having a first end and a second free end, said flexible plastic clips being attached at spaced points along the length of the back surface of said molding strip at a point of attachment intermediate the upper free edge and lower free edge of said molding strip and said second free end of each said clip extends at an acute angle relative to the molding strip from said point of attachment, said second free end of each said clip being capable of flexing relative to said point of attachment to said molding, said molding strip being sufficiently flexible about its length as well as its width to provide conforming engagement of its upper free edge and its lower free edge with the ceiling and vertical wall to provide conforming engagement with the ceiling and vertical wall, a wall track of thin flexible plastic having a back surface, a front surface, an upper edge and a forward leading edge, said forward leading edge of said track being capable of flexing relative to the remainder of said track, means for mounting the upper edge of the track on one of said ceiling and said vertical wall adjacent the juncture of said ceiling and said vertical wall, first interengaging means integral with said forward leading edge of said track, second interengaging means integral with said second free end of each said clip, said first interengaging means and said second interengaging being constructed such that when the thin molding strip with the flexible plastic clips attached thereto is mounted on said track by movement of each said second free end of each said clip between the leading edge of said track, the second free end of each said clip is moved toward the leading edge of said track and said free ends of said clips flex and said first interengaging means interengage, such that said thin molding strip is restrained against ready removal, said molding strip, clips and track being constructed and arranged such that when said molding strip is in mounted position on said wall tack, the upper edge of said molding strip is angled outwardly from said track and said clips, such that each said clip is positioned between said lower forward free edge of said wall track and its associated wall to cause the forward leading edge of said track to flex so that each said clip is retained by a snap-in fit while permitting the upper free edge and lower free edge of said molding strip to flex into conforming engagement with the ceiling and vertical wall and said strip is removable by flexing of said clips, said first interengaging means on said forward leading edge of said track and said second interengaging means on said clips being constructed and arranged such that the molding strip can be easily removed to allow for painting, wall papering, or other decoration, a retainer secured to one end of said thin molding strip at one end in a spaced relation thereto, said retainer having openings formed therein, and a connector secured to an end of an adjacent second molding strip having spring tabs formed therein, such that said connector is telescopically received between the retainer and the first molding strip so that the spring tabs are engaged within the openings in said retainer to secure the first and second molding strips end to end.

6. A decorative molding system removably installed at a juncture of a ceiling and a vertical wall, said molding system comprising:

a thin molding strip of flexible plastic having a length and a width, said thin plastic molding strip having an undulating cross sectional configuration, said thin molding strip having a cross section comprising a central stepped portion having a first vertical wall and a second horizontal wall extending substantially perpendicular to the first wall, said thin plastic molding strip having an upper free edge, a lower free edge, a front surface and a back surface, said upper free edge being adapted to lie against one of said ceiling and said vertical wall along a line spaced from the juncture of the ceiling and vertical wall and flex relative thereto, said lower free edge being adapted to lie against the other of said ceiling and said vertical wall along a line spaced from the juncture of the ceiling and vertical wall and flex relative thereto, said upper free edge and lower free edge having a configuration such that the molding strip is angled outwardly with respect to the wall and the ceiling, a plurality of flexible plastic clips, each said flexible plastic clip having a first end and a second free end, said flexible plastic clips being attached at spaced points along the length of the back surface of said molding strip at a point of attachment intermediate the upper free edge and lower free edge of said molding strip and said second free end of each said clip extends at an acute angle relative to the molding strip from said point of attachment, said second free end of each said clip being capable of flexing relative to said point of attachment to said molding, said molding strip being sufficiently flexible about its length as well as its width to provide conforming engagement of its upper free edge and its lower free edge with the ceiling and vertical wall to provide conforming engagement with the ceiling and vertical wall, a wall track of thin flexible plastic having a back surface, a front surface, an upper edge and a forward leading edge, said upper edge of said track engaging said ceiling, said forward leading edge of said track being capable of flexing relative to the remainder of said track, means for mounting the upper edge of the track on one of said ceiling and said vertical wall adjacent the juncture of said ceiling and said vertical wall, first interengaging means integral with said forward leading edge of said track, second interengaging means integral with said second free end of each said clip, said first interengaging means and said second interengaging being constructed such that when the thin molding strip with the flexible plastic clips attached thereto is mounted on said track by movement of each said second free end of each said clip between the leading edge of said track, the second free end of each said clip is moved toward the leading edge of said track and said free ends of said clips flex and said first interengaging means interengage, such that said thin molding strip is restrained against ready removal, said molding strip, clips and track being constructed and arranged such that when said molding strip is in mounted position on said wall track, the upper edge of said molding strip is angled outwardly from said track and said clips, such that each said clip is positioned between said lower forward free edge of said wall track and its associated wall to cause the forward leading edge of said track to flex so that each said clip is retained by a snap-in fit while permitting the upper free edge and lower free edge of said molding strip to flex into conforming engagement with the ceiling and vertical wall and said strip is removable by flexing of said clips, said first interengaging means on said forward leading edge of said track and said second interengaging means on said clips being constructed and arranged such that the molding strip can be easily removed to allow for painting, wall papering, or other decoration.

7. The decorative molding system set forth in claim 6 wherein the leading edge of said track is spaced from said wall leaving a gap and said leading edge having undulations corresponding to the forward edge of each clip.

8. The decorative molding system set forth in claim 7 wherein said forward edge of said clip cooperates with the undulations of said leading edge of said track to lock said clip to said track.

9. A decorative molding system removably installed at a juncture of a ceiling and a vertical wall, said molding system comprising:

a thin molding strip of flexible plastic having a length and a width, said thin plastic molding strip having an undulating cross sectional configuration, said molding strip having an upper undulating portion extending along the length thereof and a lower stepped portion along the length thereof, each said clip having a stepped portion intermediate its forward edge and the portion attached to said strip, said stepped portion including a horizontal portion and a vertical portion, said stepped portion of said each clip including a leg portion engaging and attached to the upper horizontal portion of said stepped portion of said strip, said thin plastic molding strip having an upper free edge, a lower free edge, a front surface and a back surface, said upper free edge being adapted to lie against one of said ceiling and said vertical wall along a line spaced from the juncture of the ceiling and vertical wall and flex relative thereto, said lower free edge being adapted to lie against the other of said ceiling and said vertical wall along a line spaced from the juncture of the ceiling and vertical wall and flex relative thereto, said upper free edge and lower free edge having a configuration such that the molding strip is angled outwardly with respect to the wall and the ceiling, a plurality of flexible plastic clips, each said flexible plastic clip having a first end and a second free end, each said clip having a stepped portion intermediate its free ends and the portion attached to said strip, said stepped portion including a horizontal portion and a vertical portion, said stepped portion of said clip including a leg portion engaging and attached to an upper horizontal portion of said stepped portion of said strip said flexible plastic clips being attached at spaced points along the length of the back surface of said molding strip at a point of attachment intermediate the upper free edge and lower free edge of said molding strip and said second free end of each said clip extends at an acute angle relative to the molding strip from said point of attachment, said second free end of each said clip being capable of flexing relative to said point of attachment to said molding, said molding strip being sufficiently flexible about its length as well as its width to provide conforming engagement of its upper free edge and its lower free edge with the ceiling and vertical wall to provide conforming engagement with the ceiling and vertical wall, a wall track of thin flexible plastic having a back surface, a front surface, an upper edge and a forward leading edge, said upper edge of said track engaging said ceiling, said forward leading edge of said track being capable of flexing relative to the remainder of said track, means for mounting the upper edge of the track on said vertical wall adjacent the juncture of said ceiling and said vertical wall, first interengaging means integral with said forward leading edge of said track, second interengaging means integral with said second free end of each said clip, said first interengaging means and said second interengaging being constructed such that when the thin molding strip with the flexible plastic clips attached thereto is mounted on said track by movement of each said second free end of each said clip between the leading edge of said track, the second free end of each said clip is moved toward the leading edge of said track and said free ends of said clips flex and said first interengaging means interengage, such that said thin molding strip is restrained against ready removal, said molding strip, clips and track being constructed and arranged such that when said molding strip is in mounted position on said wall track, the upper edge of said molding strip is angled outwardly from said track and said clips, such that each said clip is positioned between said lower forward free edge of said wall track and its associated wall to cause the forward leading edge of said track to flex so that each said clip is retained by a snap-in fit while permitting the upper free edge and lower free edge of said molding strip to flex into conforming engagement with the ceiling and vertical wall and said strip is removable by flexing of said clips, said first interengaging means on said forward leading edge of said track and said second interengaging means on said clips being constructed and arranged such that the molding strip can be easily removed to allow for painting, wall papering, or other decoration.

10. The decorative molding system set forth in claim 9 wherein the leading edge of said track is spaced from said wall leaving a gap and said leading edge having undulations corresponding to the forward edge of each clip.

11. The decorative molding system set forth in claim 10 wherein said forward edge of each said clip cooperates with the undulatiions of said leading edge of said track to lock said clip to said track.

* * * * *